US006082089A

United States Patent [19]

Stahlecker

[11] Patent Number: 6,082,089

[45] Date of Patent: Jul. 4, 2000

[54] ARRANGEMENT FOR CONDENSING A DRAFTED FIBER STRAND

[75] Inventor: Gerd Stahlecker, Eislingen/Fils, Germany

[73] Assignee: Wilhelm Stahlecker GmbH, Deggingen-Reichenback im Taele, Germany

[21] Appl. No.: 09/386,952

[22] Filed: Aug. 31, 1999

[30] Foreign Application Priority Data

Sep. 9, 1998 [DE] Germany ..... 198 41 089

[51] Int. Cl.[7] ..... D01H 5/28

[52] U.S. Cl. ..... 57/315; 19/246; 19/150; 57/328

[58] Field of Search ..... 19/150, 236, 237, 19/238, 239, 240, 241, 242, 243, 244, 245, 246, 247, 248, 249, 250, 252, 263, 286, 287, 288, 304, 305, 306, 307, 308; 57/264, 304, 315, 328, 333

[56] References Cited

U.S. PATENT DOCUMENTS

| | | | |
|---|---|---|---|
| 5,090,192 | 2/1992 | Stahlecker | 57/328 |
| 5,157,911 | 10/1992 | Stahlecker et al. | 57/328 |
| 5,431,005 | 7/1995 | Fehrer | 57/315 |
| 5,600,872 | 2/1997 | Artzt et al. | 19/244 |
| 5,651,244 | 7/1997 | Lucca et al. | 57/328 |

*Primary Examiner*—Michael A. Neas
*Assistant Examiner*—Gary L. Welch
*Attorney, Agent, or Firm*—Evenson, McKeown, Edwards & Lenahan, P.L.L.C.

[57] ABSTRACT

A condensing zone lies downstream of the front roller pair of a drafting unit of a spinning machine, in which condensing zone a drafted fiber strand is condensed. The condensing zone comprises a sliding surface having a suction slit, which sliding surface serves as a guide for a circulating, perforated transport belt. The transport belt transports the fiber strand to a nipping roller, which presses the fiber strand and the transport belt against the sliding surface. The nipping roller is connected to a drive, from which drive said nipping roller can be cut off in age the case of a break in the transport belt.

9 Claims, 2 Drawing Sheets

ARRANGEMENT FOR CONDENSING A DRAFTED FIBER STRAND

BACKGROUND AND SUMMARY OF THE INVENTION

This application claims the priority of German application 198 41 089.1, filed in Germany on Sep. 9, 1998, the disclosure of which is expressly incorporated by reference herein.

The present invention relates to an arrangement for condensing a drafted fiber strand in a condensing zone arranged downstream of a front roller pair of a drafting unit, which condensing zone comprises a stationary sliding surface having a suction slit extending essentially in transport direction of the fiber strand, a perforated transport belt which transports the fiber strand over the sliding surface, and a nipping roller engageable with the transport belt on an exit side of the condensing zone.

An arrangement of this type is prior art in U.S. Pat. No. 5,600,872. The condensing zone serves the purpose of further bundling and condensing the drafted fiber strand, whereby the outwardly projecting fiber ends are rolled in around the core strand. The fiber strand is still untwisted in the condensing zone. When the spinning twist is later applied downstream of the nipping roller, a thread arises which is less hairy and more tear resistant and more even. In the known arrangement, the nipping roller is pressed against a driven bottom cylinder. As a result, the suction slit ends a significant distance from the nipping point of the nipping roller. The condensed fiber strand can thus, disadvantageously, expand outwards again before it reaches the nipping point. Thus the actual purpose of the condensing zone is only partly achieved.

It is an object of the present invention to design the condensing zone in such a way that the condensed fiber strand maintains its state up until it reaches the nipping point. It is also an object of the present invention that in the case of a it possible break in the transport belt, the nipping roller is not damaged.

This object has been achieved in accordance with the present invention in that the nipping roller presses the transport belt to the sliding surface, said nipping roller being connected to a drive from which it can be cut off in the case of a break in the transport belt.

Because the nipping roller does not act together with another delivery roller, but rather with a stationary sliding surface, the suction slit can be placed right up to the nipping point. This brings the advantage with it that the pneumatically generated condensing of the fiber strand is maintained at the nipping point also, so that subsequently, a truly condensed fiber strand can be twisted to form a thread. In order that, in the case of break in the transport belt, the nipping roller, as a rule provided with a flexible coating, does not rub on the stationary sliding surface and by means of overheating is thus destroyed, it is provided that the nipping roller drive is stopped once a break in the transport belt occurs.

To this end, preferred embodiments of the drive comprises a transfer wheel which can be de-coupled by means of axial displacement from its coupled position with a driven wheel of the nipping roller. This can be achieved, for example, in that the transfer wheel as well as the driven wheel are both provided with a helical gearing. In the case of a helical gearing, an axial force arises which is proportional to the transferable torque. A spring element effects that the axial force during normal operation does not exceed the spring force. In contrast, in the case of a break in the transport belt, the axial force of the helical gearing increases due to the increased friction, so that the transfer wheel is axially displaced due to the greater torque, whereby the engagement between the transfer wheel and the driven wheel is interrupted. The spring force of the spring element must be of such a magnitude that it is greater than the axial force during normal operation, but less than the axial force in the case of a break in the transport belt.

Advantageously, a positioning device for establishing the de-coupled position is arranged at the spring element while the transfer wheel is in a de-coupled state. This ensures that the spring force does not press the transfer wheel back into the operational position again as long as the transport belt is not in perfect working order. It is advantageous when the positioning device comprises a holding magnet according to certain preferred embodiments of the invention. This can on the one hand reinforce the axial force at the end of the displacement motion, while on the other hand, it is in the position to hold the transfer wheel in the de-coupled position. The magnetic force must hereby be greater than the spring force effective during operation.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
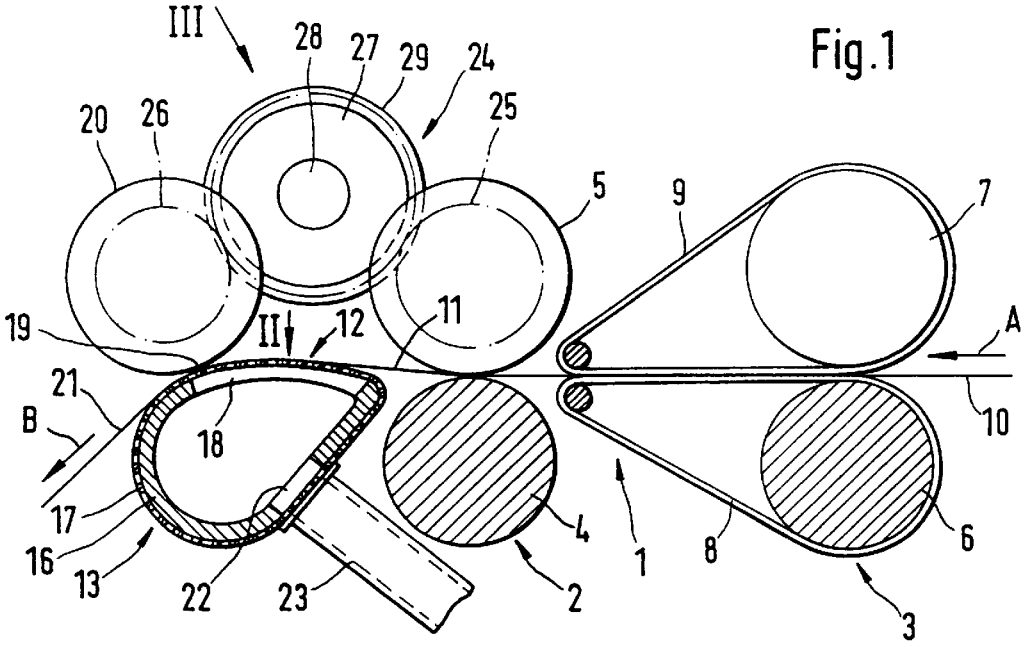
FIG. 1 is a partly sectional schematic side view through an arrangement constructed according to a preferred embodiment of the present invention.

In FIG. 1 only the front roller pair 2 and the apron roller pair 3 upstream thereof are shown of the drafting unit 1 of a spinning station of a ring spinning machine. The front roller pair 2 comprises a driven bottom roller 4, which extends over a plurality of spinning stations, and also a top roller 5 arranged at each spinning station. In a similar way, the apron roller pair 3 comprises a driven bottom roller 6 as well as a top roller 7 per spinning station. A lower apron 8 and a top apron 9 can also be seen.

Figure 2:
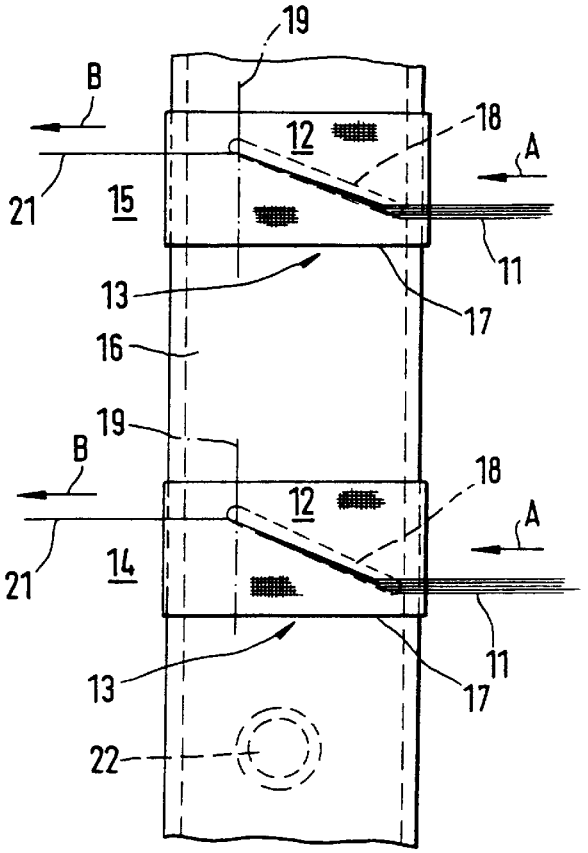
FIG. 2 is a view in the direction of arrow II of FIG. 1 onto the condensing zone of the arrangement of FIG. 1.

In the drafting unit 1, a sliver or roving 10 is transported in the known way in transport direction A and hereby drafted to the desired degree of fineness. Directly downstream of the front roller pair 2, a drafted, but still untwisted fiber strand 11 is present, see also FIG. 2.

A condensing zone 12 is arranged downstream of the drafting unit 1, at which condensing zone 12 an arrangement 13 for condensing the fiber strand 11 is arranged. As can be seen from FIG. 2, the arrangement 13 can comprise a hollow profile 16, which extends over a plurality of spinning stations 14,15. The outer contour of the hollow profile 16 is a stationary sliding surface, at which one transport belt 17 per spinning station 14,15 is arranged.

The transport belt 17 pertaining to the condensing zone 12 is perforated and consists preferably of a close-meshed woven material of polyamide threads. The transport belt 17 transports the fiber strand 11 to be condensed through the condensing zone 12 and over a suction slit 18 of the sliding surface. The suction slit 18 is somewhat wider than the intended completely condensed fiber strand 11 and is inclined slightly transversely in transport direction A, so that the fiber strand 11 obtains a false twist during condensing. The suction slit 18 extends up to a nipping point 19, which is formed between a nipping roller 20 and the sliding surface of the hollow profile 16, said nipping point 19 bordering the exit side of the condensing zone 12. The nipping roller 20 presses the fiber strand 11 and the transport belt 17 against the sliding surface.

Downstream of the nipping point 19, a thread or yarn 21 is present, in which the spinning twist is applied. The nipping roller 20 serves as a twist block for the spinning twist, so that the fiber strand 11 is twist-free in the condensing zone 12. Downstream of the nipping point 19, the thread 21 is fed in delivery direction B to a ring spindle (not shown).

The hollow profile 16 comprises per machine section a suction opening 22, which is connected to a vacuum source (not shown) by means of a suction tube 23. Thus a suction action is exerted through the perforated transport belt 17 on the fiber strand 11 to be condensed.

The nipping roller 20 is connected to a drive 24, which is derived from the top roller 5 of the front roller pair 2. The peripheral speed of the nipping roller 20 is hereby slightly greater than the peripheral speed of the front roller pair 2.

The drive 24 is so designed that it comes to a standstill in the case of a break in the transport belt 17. The drive 24 comprises a transfer wheel 27, which is coupled to a drive wheel 25 of the pressure roller 5 as well as with a driven wheel 26 of the nipping roller 20. The coupling is achieved by means of a helical gearing 29. Only the respective reference circle of the drive wheel 25 and the driven wheel 26 is denoted in the drawings.

The transfer wheel 27 is supported with clearance on an axle 28 and is axially displaceable in such a way that, in the case of a break in the transport belt 17, the transfer wheel 27 slides sideways out of the engagement with the drive wheel 25 and the driven wheel 26.

Figure 3:
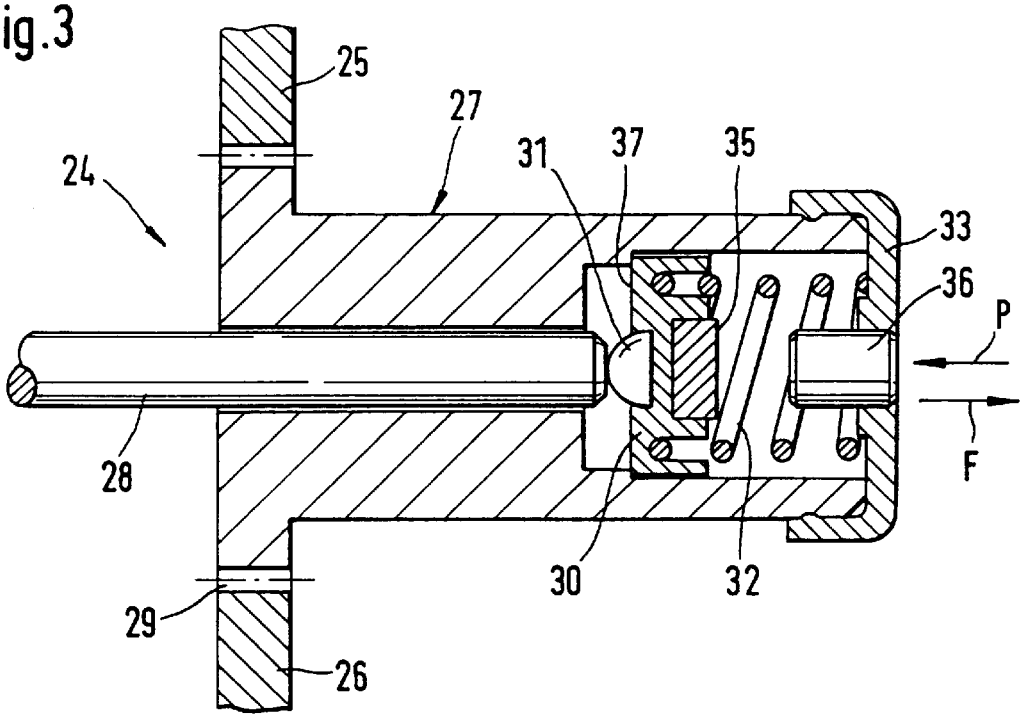
FIG. 3 is an enlarged view in the direction of the arrow III of FIG. 1 onto the transfer wheel, shown in a coupled driving position.
Figure 4:
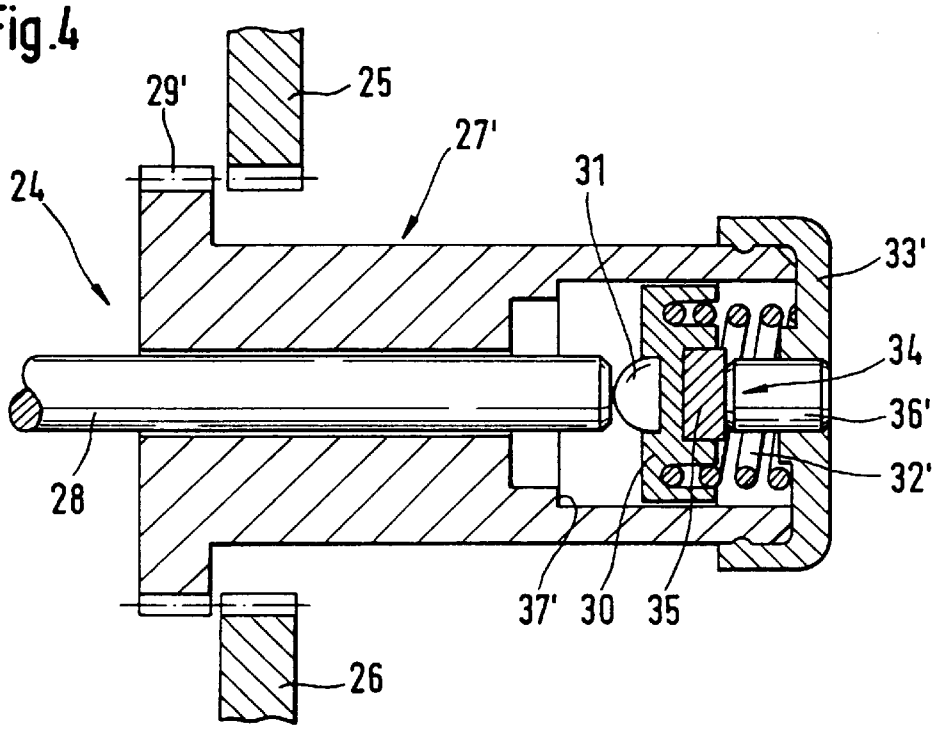
FIG. 4 shows the transfer wheel of FIG. 3 in a de-coupled state.

In FIG. 3, a transfer wheel 27 is shown during normal operational position, and in FIG. 4 the same transfer wheel 27 is shown in a de-coupled position after an end break. The preference numbers of the components, which are shown in axial displacement, are followed by. The reference number 27 thus denotes the transfer wheel 27 in the de-coupled position.

As a result of the helical gearing 29, an axial force P is continuously exerted during operation on the axially displaceable supported transfer wheel 27, which axial force P has a tendency to push the transfer wheel 27 laterally. This pushing movement is counter-effected by a spring force F, which, during normal operation, is greater than the axial force P. The spring force F is generated by a spring element 32 in the form of a helical spring, which on the one hand is supported against a spring plate 30 and on the other hand against a supporting lid 33. The spring plate 30 is supported in an axially displaceable way in a cylindrical bore hole of the transfer wheel 27, while the supporting lid 32 is affixed in axial direction on the transfer wheel 27.

The spring plate 30 is supported axially on the axle 28 continuously by means of a supporting ball 31, which can be semihemispherical in form. During operation, the spring plate 30 is supported on a stopper 37 of the bore hole of the transfer wheel 27. The latter is shown in FIG. 3.

When a transport belt 17 breaks, the friction between the nipping roller 20 and the sliding surface of the hollow profile 16 increases significantly. This results in an increase in the torque between the nipping roller 20 and the sliding surface. This increases also the axial force P to such a degree that it becomes significantly greater than the spring force F. The transfer wheel 27 is thus brought into a de-coupled position according to FIG. 4 as a result of the increased axial force P.

This displacement movement is supported by a positioning device 34 located in the above mentioned bore hole. This positioning device 34 comprises a holding magnet 35, which is applied centrically in the spring plate 30. During operation, a holding pin 36, applied to the supporting lid 33,is adjacent to the holding magnet 35. As a result of the displacement movement described above, the holding pin 36 nears the holding magnet 35, so that the magnetic force increases the axial force P at the end of the displacement movement. This ensures that the transfer wheel 27 is guided out of the engagement with the drive wheel 25 and the driven wheel 26. The magnetic force of the holding magnet 35 is greater than the spring force F and therefore able to hold the holding pin 36 in the de-coupled state and thus fix the entire transfer wheel 27 in the de-coupled position 27'.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A condensing arrangement for condensing a drafted fiber strand in a condensing arrangement zone arranged downstream of a front roller pair of a drafting unit, said condensing arrangement comprising:

a stationary sliding surface having a suction slit extending essentially in a transport direction of a fiber strand, a perforated transport belt which transports the fiber strand over the sliding surface, and a nipping roller engageable against the fiber strand and transport belt at a position bordering the condensing zone on an exit side thereof, wherein the nipping roller presses the transport belt toward the sliding surface during fiber strand condensing operation, said nipping roller being connected to a selectively engageable drive which is disengaged in response to a break in the transport belt.

2. An arrangement according to claim 1, wherein the drive comprises a transfer wheel, which transfer wheel can be brought out of a coupled position with a driven wheel of the nipping roller by means of axial displacement into a de-coupled position.

3. An arrangement according to claim 2, wherein the transfer wheel and the driven wheel each have a helical gearing, thereby generating an axial force which is compensated during normal operation of the transport belt by means of a spring element, said spring element exerting a spring force which is less than an increased axial force generated in the case of a break in the transport belt to thereby result in movement of the transfer wheel out of driving engagement with the driven wheel.

4. An arrangement according to claim 3, wherein a positioning device for fixing the decoupled position is arranged at the spring element when the transfer wheel is in a de-coupled state.

5. An arrangement according to claim 4, wherein the positioning device comprises a holding magnet.

6. An arrangement according to claim 1, wherein the drive for the nipping roller is drivingly connected with a drive for the drafting unit.

7. A yarn spinning assembly comprising:

a drafting unit for drafting a fiber strand, a condensing assembly disposed downstream of the drafting unit and operable to condense the fiber strand in a condensing zone, and a spinning unit disposed downstream of the condensing assembly and operable to apply twist to the fiber strand supplied from the condensing assembly to form a yarn, wherein said condensing assembly includes:

(i) a stationary sliding surface, (ii) a suction slit in the sliding surface, (iii) a perforated transport belt operable to transport the fiber strand over the sliding surface, (iv) a nipping roller operable to press the fiber strand against the sliding surface at a downstream end of the condensing zone, and (v) a nipping roller drive unit for rotatably driving the nipping roller, said nipping roller drive unit including a decoupling arrangement operable to interrupt the drive of the nipping roller in response to breakage of the transport belt.

8. A yarn spinning assembly according to claim 7, wherein said nipping roller drive unit includes a transfer wheel which drivingly engages a nipping roller wheel rotatable with the nipping roller, and wherein said decoupling arrangement includes means to axially move the transfer wheel to a position out of driving engagement with the nipping roller wheel.

9. A yarn spinning assembly according to claim 8, wherein said decoupling arrangement is responsive to increased friction forces on the nipping roller wheel in the event of a transport belt breakage to thereby axially move the transfer wheel out of driving engagement with the nipping roller wheels.

* * * * *